US007614578B2

(12) United States Patent
Ito

(10) Patent No.: US 7,614,578 B2
(45) Date of Patent: Nov. 10, 2009

(54) HEADPHONE WITH CORD REEL

(75) Inventor: Tomohiro Ito, Kanagawa (JP)

(73) Assignee: Sony Corporation, Tokyo (JP)

( * ) Notice: Subject to any disclaimer, the term of this patent is extended or adjusted under 35 U.S.C. 154(b) by 24 days.

(21) Appl. No.: 11/578,671

(22) PCT Filed: Apr. 14, 2005

(86) PCT No.: PCT/JP2005/007580

§ 371 (c)(1),
(2), (4) Date: Oct. 17, 2006

(87) PCT Pub. No.: WO2005/104605

PCT Pub. Date: Nov. 3, 2005

(65) Prior Publication Data

US 2007/0194162 A1 Aug. 23, 2007

(30) Foreign Application Priority Data

Apr. 22, 2004 (JP) ..... 2004-126907

(51) Int. Cl.
*B65H 75/48* (2006.01)

(52) U.S. Cl. ..... 242/385.4

(58) Field of Classification Search ..... 242/385, 242/385.1, 385.2, 385.3, 385.4; 403/330, 403/325; 16/78; 292/DIG. 56
See application file for complete search history.

(56) References Cited

U.S. PATENT DOCUMENTS 3,193,049 A * 7/1965 Wollek ..... 181/208
5,106,134 A * 4/1992 Thau ..... 292/216
2006/0239491 A1 10/2006 Ito

FOREIGN PATENT DOCUMENTS

| | | | |
|---|---|---|---|
| GB | 2283782 A | * | 5/1995 |
| JP | 57 91389 | | 6/1982 |
| JP | 59 106254 | | 7/1984 |
| JP | 60 145782 | | 9/1985 |
| JP | 63 134075 | | 9/1988 |
| JP | 3 127739 | | 12/1991 |
| JP | 2000 253477 | | 9/2000 |

OTHER PUBLICATIONS

Translation of JP 2000-253477.*
U.S. Appl. No. 11/578,671, filed Oct. 17, 2006, Ito.

* cited by examiner

*Primary Examiner*—John Q. Nguyen
*Assistant Examiner*—William E Dondero
(74) *Attorney, Agent, or Firm*—Oblon, Spivak, McClelland, Maier & Neustadt, L.L.P.

(57) ABSTRACT

A headphone with a cord take-up device is provided, which is put into practice relatively easily and which prevents a harsh clicking sound from arising when an input cord is pulled out of a headphone housing.

The headphone with a cord take-up device includes: an input cord; take-up means provided in a housing and forced to wind and retract the input cord into the housing; ratchet means interacting with the take-up means, including a ratchet wheel and an engaging pawl provided at one end of a turning arm and forced toward the side of the ratchet wheel, preventing the input cord from being wound and retracted by the take-up means and allowing the input cord to be pulled out of the housing; and a buffer material provided between the turning arm and the housing; wherein movement of the engaging pawl at one end of the turning arm is restricted by the buffer material when the input cord is pulled out of the housing.

9 Claims, 3 Drawing Sheets

HEADPHONE WITH CORD REEL

TECHNICAL FIELD

The present invention relates to a headphone with a cord take-up device, suitably applied to a headphone used for portable audio equipment, for example.

BACKGROUND ART

Lately, with portable audio equipment and the like being developed, headphones have become frequently used outdoors as well. In the case where the headphones are carried, tangling of input cords and the like are problematic.

Accordingly, there has been proposed a headphone with a cord take-up device, incorporating a mechanism which winds and retracts an input cord of the headphone into a housing of the headphone. The input cord take-up mechanism of the headphone with the cord take-up device is configured to have take-up means provided in a headphone housing and forced to wind and retract an input cord into the housing and ratchet means interacting with the take-up means, including a ratchet wheel in the form of a metal plate and an engaging pawl that is provided at one end of a turning arm in the form of a metal plate and that is forced toward the side of the ratchet wheel, preventing the input cord from being wound and retracted by the take-up means and allowing the input cord to be pulled out of the housing.

Thus, when the input cord is pulled out of the housing, there is an inconvenience that a harsh clicking sound is generated every time the engaging pawl in the form of a metal plate gets over a pawl portion of the ratchet wheel in the form of a metal plate.

Therefore, Patent Document 1 of related art proposes a structure in which such harsh clicking sound is reduced by providing a buffer material such as soft rubber or synthetic resin for a part of the engaging pawl in the form of a metal plate which comes in contact with the pawl portion each time the engaging pawl getting over the ratchet wheel in the form of a metal plate.

[Patent Document 1] Japanese Published Patent Application No. 2000-253477

DISCLOSURE OF THE INVENTION

However, since most of the volume has to be used for the storage space for the input cord, the part of the pawl portion of the ratchet wheel, which is in contact with the engaging pawl in the form of a metal plate, is considerably thin; thus, the buffer material provided for the engaging pawl is required to have both flexibility with which sound is muffled efficiently in a narrow area and durability with which the pawl portion of the ratchet wheel moving frenetically and the engaging pawl withstand several tens of thousands or more of violent collisions, which is therefore extremely difficult to put into practice.

Further, the engaging pawl is also in the form of a thin metal plate, and so it is extremely difficult as well to arrange the buffer material not to be detached even after violent collisions of several tens of thousands times or more.

The present invention aims to have a structure which is put into practice relatively easily and with which a harsh clicking sound is prevented from being generated when an input cord is pulled out of a headphone housing.

A headphone with a cord take-up device according to the present invention includes: an input cord; take-up means provided in a housing and forced to wind and retract the input cord into the housing; ratchet means interacting with the take-up means, including a ratchet wheel and an engaging pawl provided at one end of a turning arm and forced toward the side of the ratchet wheel, preventing the input cord from being wound and retracted by the take-up means and allowing the input cord to be pulled out of the housing; and a buffer material provided between the turning arm and the housing; wherein when the input cord is pulled out of the housing, movement of the engaging pawl at one end of the turning arm is restricted by the buffer material.

According to the present invention, since the buffer material is provided between the turning arm having the engaging pawl at one end thereof and the housing, therefore, the operation range of the engaging pawl is restricted by the buffer material, and the engaging pawl is kept from hitting the pawl portion of the ratchet wheel to barely avoid collision, thereby preventing a collision sound from being generated.

The buffer material can be arranged in a free space inside the housing, which does not limit the cord storage space, so that a sufficient area can be secured and the buffer material can therefore be put into practice easily; and also, inexpensive materials having sufficient durability, such as neoprene sponge, can be selected for the buffer material, so that a sound-muffling effect can surely be obtained for a long time.

BEST MODE FOR CARRYING OUT THE INVENTION

Hereinafter, an embodiment of a headphone with a cord take-up device according to the present invention is explained with referring to FIGS. 1 to 4.

Figure 2:
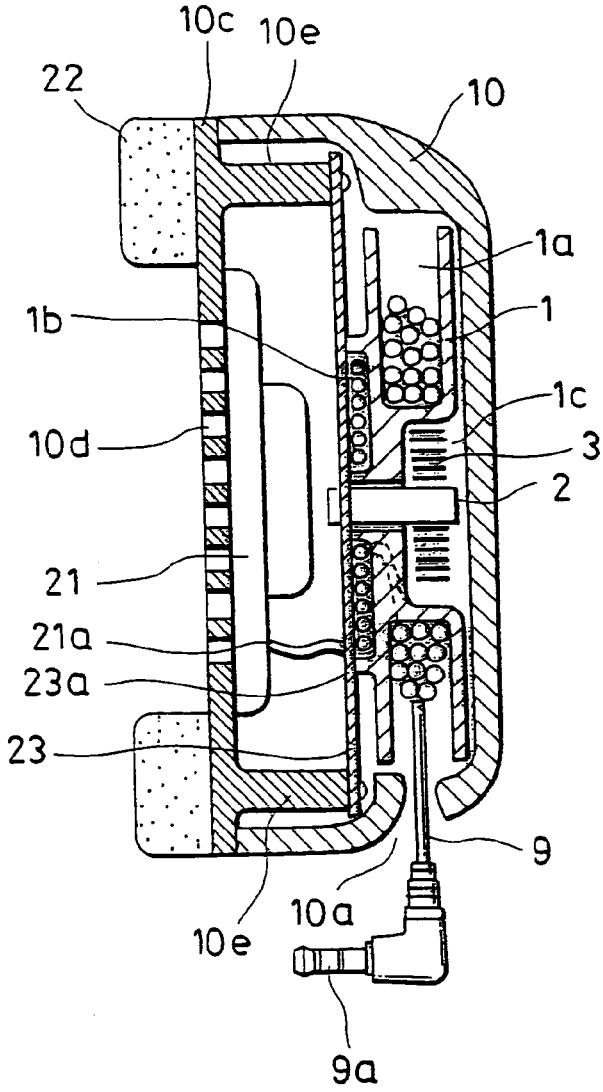
FIG. 2 is a sectional view showing an example of a headphone with a cord take-up device.

First, a headphone with a cord take-up device will be schematically explained with referring to FIG. 2.

In FIG. 2, a reference numeral 10 denotes a headphone housing; in a front housing 10*c* of the headphone housing 10 are provided front opening holes 10*d* facing the external ear canal of a human ear, and a loudspeaker unit 21 is installed facing these front opening holes 10*d*.

Also, an ear pad 22 is attached to the periphery of the front of the front housing 10*c*; a take-up device board 23 is installed at the end of a prop 10*e* that is integrally formed with the front housing 10*c* and that extends toward the back, namely, in a direction away from the ear; a spindle 2 is planted in an upright position in the take-up device board 23; and a reel 1 is installed on the spindle 2 in a freely rotatable manner.

In the reel 1 are provided: a cord take-up portion 1*a* which winds and retracts an input cord 9 in a spiral manner; a cord slack portion 1*b* at the center of the cord take-up portion 1*a*; and a spring storage portion 1*c* divided on the opposite side to the cord slack portion 1*b*.

The input cord 9, one end of which is electrically connected to a terminal portion 21*a* of the loudspeaker unit 21 by soldering or the like, enters the cord slack portion 1*b* from a hole 23*a* provided in the take-up device board 23 and is loosely wound in the spiral manner several times there; further, the input cord 9 penetrates through the inside of the reel 1 and is fixed to the reel 1 at this part, and it enters the cord take-up portion 1*a* and is wound thereon.

The headphone housing 10 covers a take-up device from behind, and a cord pullout hole 10*a* from which the input cord 9 is pulled out is provided at the bottom of the headphone housing 10; at the end of the input cord 9 pulled therefrom is provided a plug 9*a* to be connected to audio equipment or the like.

Figure 1:
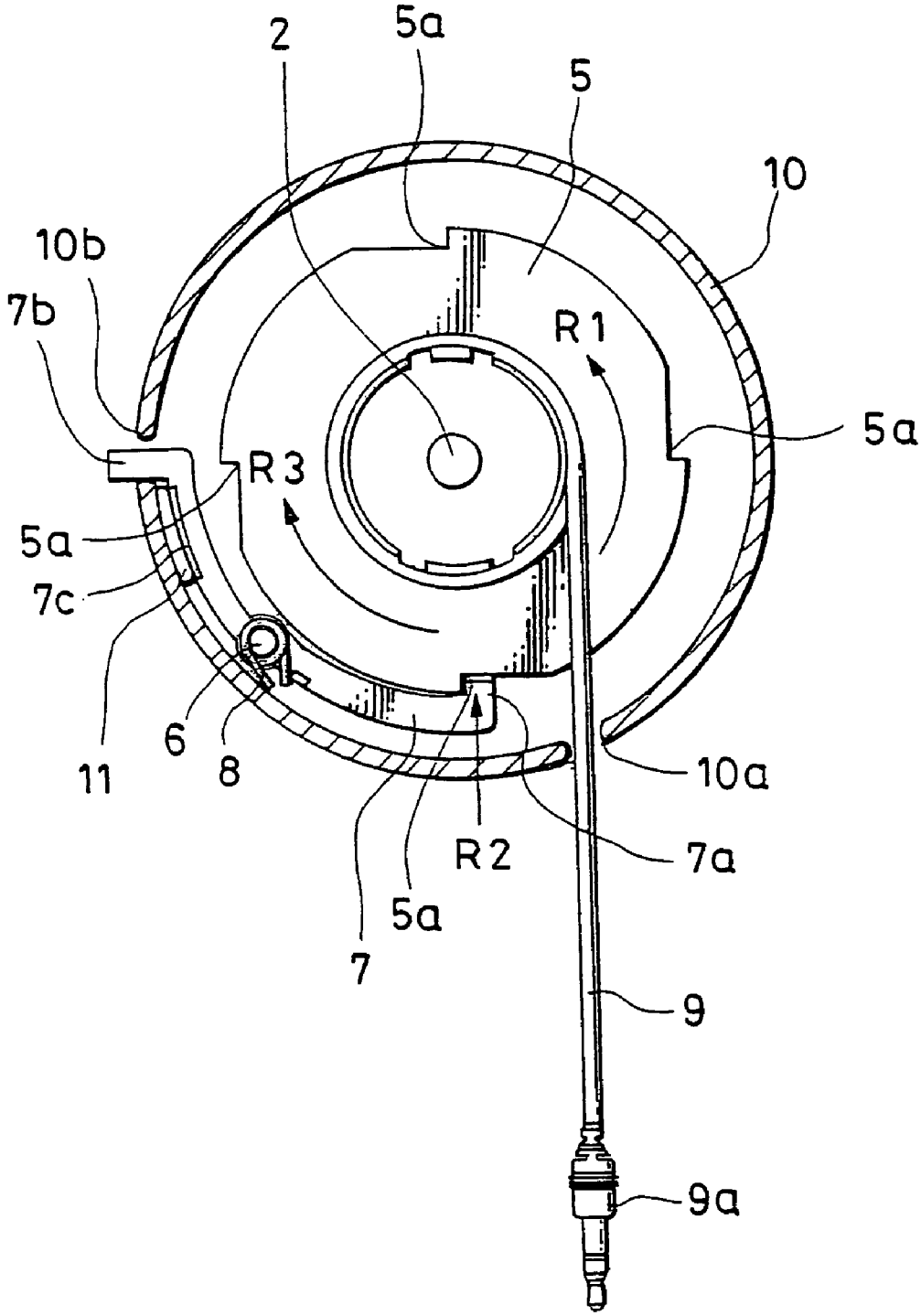
FIG. 1 is a structural view showing a relevant part of a headphone with a cord take-up device according to an embodiment of the present invention.

In this regard, take-up means is constructed, being forced in the direction of the arrow R1 in FIG. 1 by a spring 3, one end of which is fastened to the spindle 2 and the other end of which is fastened to the inner surface of the spring storage portion 1*c* of the reel 1.

Also, one of the flanges on both sides of the reel 1 is made a ratchet wheel 5 formed of a thin resin board (see FIG. 1); and the ratchet wheel 5 is provided with locking pawl portions 5*a* which are formed, for example, with four cuts made by equally dividing the perimeter of the ratchet wheel 5 by a certain integer, for example four, as shown in FIG. 1.

Also, as shown in FIGS. 1 and 3, an engaging pawl 7*a* is provided at one end of a turning arm 7 pivotally supported by a shaft 6 in a turnable manner. In order that the engaging pawl 7*a* at one end of the turning arm 7 is pressed to engage with a locking pawl portion 5*a* of the ratchet wheel 5, the engaging pawl 7*a* of the turning arm 7 is forced in the direction of the arrow R2, namely, in the direction of the ratchet wheel 5, by a forcing spring 8 whose one end is joined to the turning arm 7 and whose other end is joined to the housing 10.

The relationship between the locking pawl portions 5*a* of the ratchet wheel 5 and the engaging pawl 7*a* at one end of the turning arm 7 is as follows: regarding the direction in which the input cord 9 is pulled out, in other words, when the ratchet wheel 5 rotates in the direction of the arrow R3, the engaging pawl 7*a* is made to proceed on the gentle slope side where it does not engage with the locking pawl portions 5*a*, so that it does not engage with these locking pawl portions 5*a*, and the input cord 9 can be pulled out (is allowed to be pulled out) from the housing 10 by applying force greater than that of the spring 3.

Also, regarding the direction in which the input cord 9 is wound and retracted, in other words, when the ratchet wheel 5 rotates in the direction of the arrow R1, the engaging pawl 7*a* engages with a locking pawl portion 5*a* of the ratchet wheel 5 and is thus locked, preventing the input cord 9 from being wound and retracted.

The locking pawl portions 5*a* of the ratchet wheel 5 and the engaging pawl 7*a* at one end of the turning arm 7 constitute what is called ratchet means.

Also, a cancellation button 7*b*, with which the prevention of the winding and retracting of the input cord 9 by the ratchet means is canceled, is provided at the other end of the turning arm 7, and the cancellation button 7*b* is made to protrude from an opening 10*b* of the headphone housing 10.

In this regard, when the cancellation button 7*b* at the other end of the turning arm 7 is operated, the engagement between a locking pawl portion 5*a* of the ratchet wheel 5 and the engaging pawl 7*a* at one end of the turning arm 7 is cancelled, so that the input cord 9 is wound and retracted into the headphone housing 10 by means of the force of the spring 3.

Figure 4:
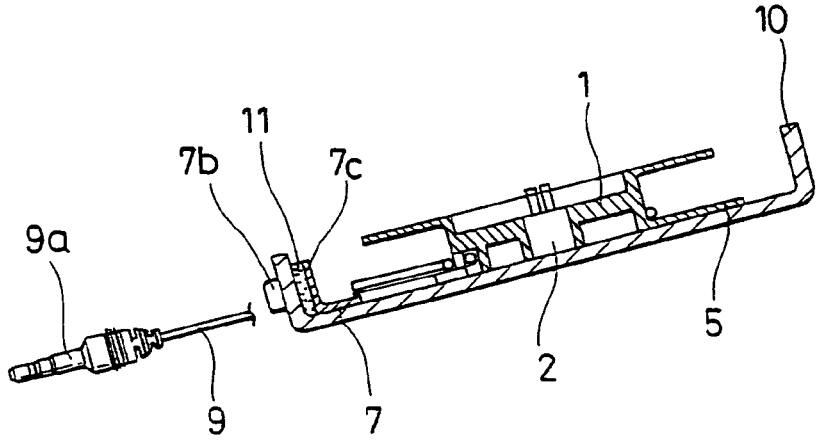
FIG. 4 is a sectional view showing an example of a relevant part of the present invention.

In this embodiment, as shown in FIGS. 1, 3 and 4, a wide portion of predetermined size is provided on the other end side of the turning arm 7 close to the cancellation button 7*b* at the other end; the wide portion is bent to form a parallel surface portion 7*c* which is parallel with the inner surface of the headphone housing 10; and a buffer material 11, made of neoprene sponge or the like, of predetermined size and predetermined height is provided using adhesion on the inner surface of the headphone housing 10 facing the parallel surface portion 7*c* of the turning arm 7.

The headphone with the cord take-up device according to this embodiment is constructed as described above; therefore, when the cancellation button 7*b* of the turning arm 7 is operated, the engagement between a locking pawl portion 5*a* of the ratchet wheel 5 and the engaging pawl 7*a* at one end of the turning arm 7 is canceled, so that the input cord 9 can be wound and retracted into the headphone housing 10 by means of the force of the spring 3.

Figure 3A:
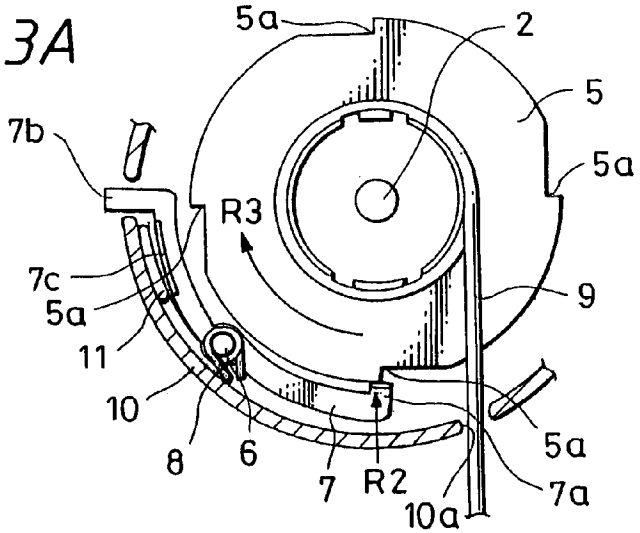
FIGS. 3A to 3D are diagrams for explaining the present invention.

Also, when the input cord 9 is pulled out of the headphone housing 10, the input cord 9 is pulled out by applying force greater than that of the spring 3 thereto. On this occasion, as shown in FIGS. 3A, 3B and 3D, the ratchet wheel 5 rotates in the direction of the arrow R3; and regarding the locking pawl portions 5*a*, the gentle slope side, which does not engage with the engaging pawl 7*a*, is brought in contact with the engaging pawl 7*a*, so that the locking pawl portions 5*a* and the engaging pawl 7*a* do not engage with each other, and the input cord 9 can therefore be pulled out.

When the applied force with which the input cord 9 is pulled out is stopped after the input cord 9 has been extended to a desired position, the ratchet wheel 5 rotates in the direction of the arrow R1 by means of the force of the spring 3, and the engaging pawl 7*a* engages with a locking pawl portion 5*a* of the ratchet wheel 5 and is thus locked, making it possible to lock the input cord 9 with a desired length.

Figure 3B:
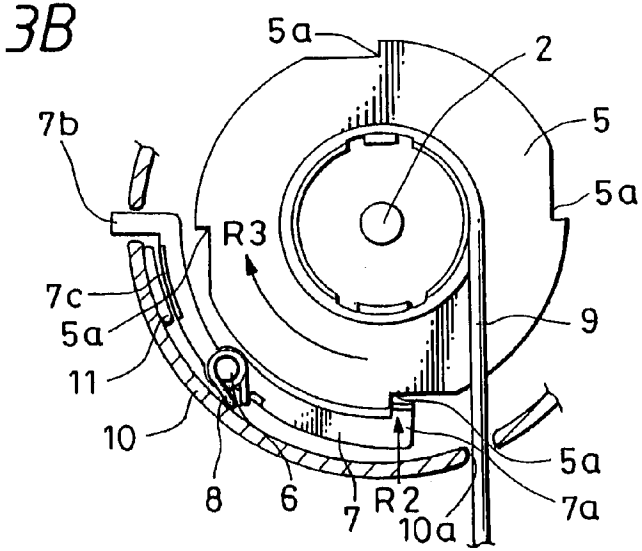
Figure 3C:
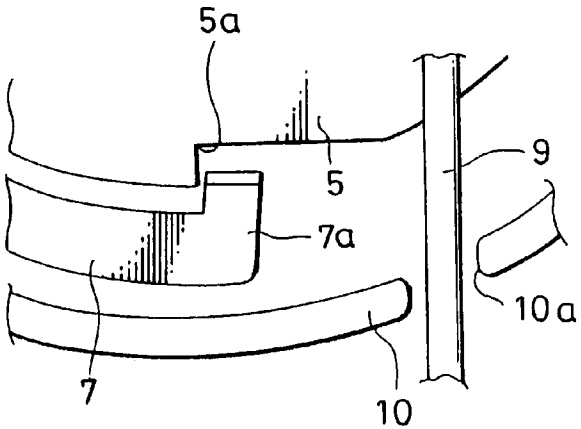
Figure 3D:
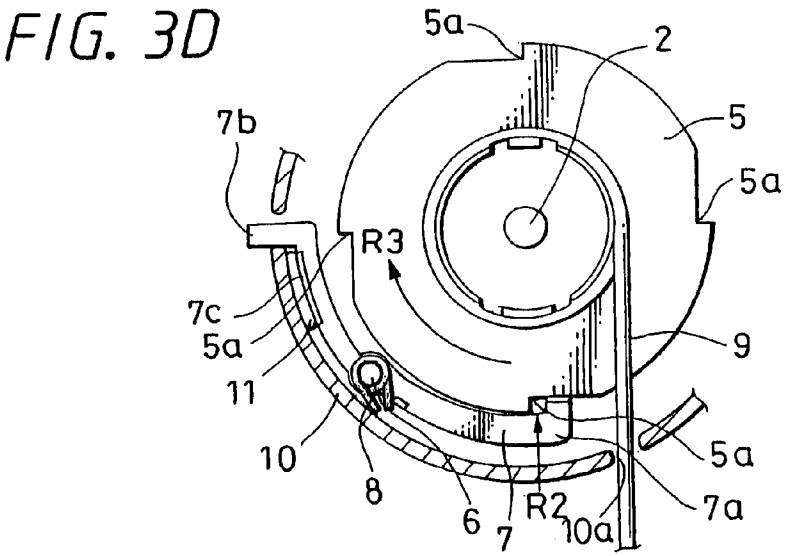

In this regard, according to this embodiment, the bent parallel surface portion 7*c* is formed on the other end side of the turning arm 7, which has the engaging pawl 7*a* at one end thereof, and also the buffer material 11, made of neoprene sponge or the like, of predetermined size and predetermined height is provided on the inner surface of the headphone housing 10 facing the parallel surface portion 7*c*, so that the operation range of the engaging pawl 7*a* is restricted by the buffer material 11, and as shown in FIG. 3C that is an enlarged view of FIG. 3B, the engaging pawl 7*a* is kept from hitting a locking pawl portion 5*a* of the ratchet wheel 5 in such a manner as to barely avoid collision, thereby preventing a collision sound from arising.

Therefore, a harsh clicking sound is not generated when the input cord 9 is pulled out of the headphone housing 10.

Also, according to this embodiment, the buffer material 11 can be arranged in a free space inside the housing 10, which does not limit the cord storage space inside the headphone housing 10, so that a sufficient area can be secured and the buffer material 11 can therefore be put into practice easily; also, inexpensive materials with excellent durability, such as neoprene sponge, can be selected for the buffer material 11, so that a sound-muffling effect can be obtained for a long time.

Furthermore, in this embodiment, since the parallel surface portion 7*c* is provided for the turning arm 7 at a position corresponding to the buffer material 11, a sound-muffling effect can surely be obtained for a long time.

It should be appreciated that although the number of locking pawl portions 5*a* of the ratchet wheel 5 is four in the above-mentioned example, the number may be different as long as it is two or more.

Also in the above embodiment, although an example in which the present invention was applied to a headphone was described, it should be appreciated that the present invention can also be applied to what is called a headset in which headphones are provided with a microphone.

Also, the present invention is not limited to the above-mentioned example, it should be appreciated that various other structures can be employed without deviating from the gist of the present invention.

INDUSTRIAL APPLICABILITY

According to the present invention, a buffer material is provided between a turning arm, which has an engaging pawl at one end thereof, and a housing; accordingly, the operation range of the engaging pawl is restricted by the buffer material, and the engaging pawl is kept from hitting a pawl portion of a ratchet wheel in such a manner as to barely avoid collision, thereby preventing a collision sound from arising.

The invention claimed is:

1. A headphone, comprising:

an input cord;

a take-up unit provided in a housing to take up said input cord into said housing;

a ratchet wheel rotatable in conjunction with said take-up unit, said ratchet wheel being provided with at least one locking pawl portion;

a pivotally supported turning arm pivotally mounted relative to said casing to provide one end portion of the turning arm at one side of the pivotal mounting and another end portion of the turning arm at another side of the pivotal mounting;

an engaging pawl provided at the one end portion of said turning arm, said engaging pawl being engaged with said at least one locking pawl portion when being forced toward said ratchet wheel; and a buffer material provided between the another end portion of said turning arm and said housing.

2. A headphone according to claim 1, wherein the buffer material is provided at a location such that the movement of said engaging pawl is restricted by said buffer material so that the engaging pawl does not contact said at least one locking pawl portion when said input cord is pulled out of said housing.

3. A headphone according to claim 1, wherein said buffer material is a neoprene sponge.

4. A headphone according to claim 1, wherein said buffer material is provided on the inner surface of said housing.

5. A headphone according to claim 4, wherein said buffer material is provided using adhesion.

6. A headphone according to claim 1, wherein the length of said buffer material is longer than the length of said engaging pawl.

7. A headphone according to claim 1, further comprising a cancellation button at the other side of said turning arm.

8. A headphone according to claim 1, wherein a surface of the another end portion faces an inner surface of the housing and extends parallel to the inner surface of the housing when the turning arm is pivoted such that the engaging pawl is engaged with said at least one locking pawl portion, and the buffer material is provided between the surface of the another end portion of said turning arm and the inner surface of said housing.

9. A headphone according to claim 8, wherein said buffer material is provided on the inner surface of said housing.

* * * * *